United States Patent [19]

Raftery

[11] 4,456,212

[45] Jun. 26, 1984

[54] HEIGHT ADJUSTABLE FURNITURE SUPPORT

[75] Inventor: William B. Raftery, Arlington, Tex.

[73] Assignee: Steelcase, Inc., Grand Rapids, Mich.

[21] Appl. No.: 466,154

[22] Filed: Feb. 14, 1983

[51] Int. Cl.[3] ..... F16M 11/24

[52] U.S. Cl. ..... 248/558; 248/188.2; 248/219.2; 403/4; 108/12

[58] Field of Search ..... 248/558, 188, 188.2, 248/188.9, 219.2, 357, 158, 159; 108/12, 144; 403/3, 4

[56] References Cited

U.S. PATENT DOCUMENTS

| | | | |
|---|---|---|---|
| 1,806,295 | 5/1931 | Kinnard | 248/27.1 |
| 1,902,511 | 3/1933 | McDaniel | 248/159 |
| 2,750,709 | 6/1956 | Saverino | 248/558 |
| 2,915,270 | 12/1959 | Gladsden | 248/219.2 |
| 3,696,242 | 10/1972 | Patry | 248/219.2 |
| 4,074,941 | 2/1978 | Jablonski | 248/219.2 |

FOREIGN PATENT DOCUMENTS

| | | | |
|---|---|---|---|
| 1624 | of 1913 | United Kingdom | 248/188.2 |
| 932312 | 7/1963 | United Kingdom | 248/357 |

*Primary Examiner*—William H. Schultz
*Assistant Examiner*—Robert A. Olson
*Attorney, Agent, or Firm*—Alexander & Zalewa, Ltd.

[57] ABSTRACT

A height adjustable furniture support for a table or the like having a pedestal or base with a substantially vertical column. A reversible collar fits onto and can be secured to the column, the collar also cooperates with and is securable to a support plate to which the table top or other furniture piece is then attached. The combination of the pedestal, reversible collar, and support plate provides a choice of two heights which can differ by more than the overall height of the collar.

8 Claims, 6 Drawing Figures

HEIGHT ADJUSTABLE FURNITURE SUPPORT

BACKGROUND OF THE INVENTION

Furniture is generally made in a limited number of standard heights. For example, most of the demand for conference tables is in either 27 inch or 29 inch heights. Making and stocking furniture, such as conference tables, in different heights results in an increase of inventory and attendant costs.

Some furniture supports have been made with variable pneumatic or mechanical height adjustments similar to that employed for automobile jacks. However, such devices only work satisfactorily on furniture supported by a single column or pedestal. It is difficult to position furniture such as a conference table at a proper level when there are two or more adjustable pedestals.

The height of a 27 inch table may be increased by attaching two inch casters to the bottom of each support, and this adjustment may even be accomplished by the consumer. However, this approach has the disadvantage of making a piece of furniture portable or easily movable, when the consumer may wish it to be more stationary. Furthermore, the addition of the casters could result in an adverse aesthetic effect on the piece of furniture.

An object of this invention is therefore to have a table support that makes it possible to adjust the height of the table top. A further object of this invention is to make the table top adjustment without using support columns of various lengths. A still further object of this invention is to have an adjustable assembly so that the height change, whether up or down, may be made without any additional parts or special tools.

SUMMARY OF THE INVENTION

The present invention involves a height adjustable furniture support for tables or the like having a pedestal or base with a substantially vertical column and a support plate to which the table top or the like is attached. A reversible collar is provided that cooperates with both the column and the support plate in such a manner that one of two pre-selected heights are available for the furniture.

The reversible collar has a load bearing seat that fits onto the column in either of the two collar positions. The support plate is provided with an opening in which the body of the collar can be received. A flange on the collar, parallel to the load bearing seat, abuts the support plate and limits the receipt of the collar in the support plate opening. The collar is secured to both the column and the support plate by means of threaded fasteners so that the consumer has available the option of changing the height if it is desirable to do so.

BRIEF DESCRIPTION OF THE DRAWINGS

For a better understanding of the present invention, reference may be had to the accompanying drawings in which.

DESCRIPTION OF THE PREFERRED EMBODIMENT

Figure 1:
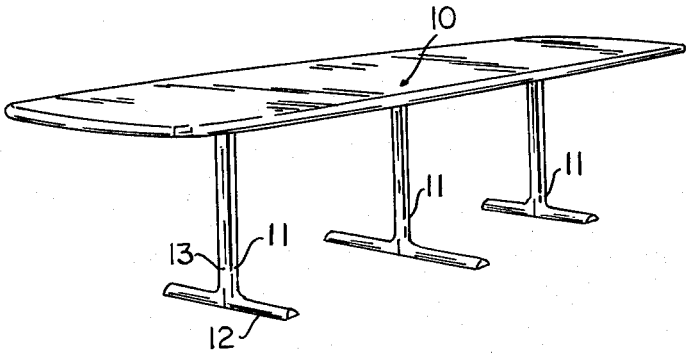
FIG. 1 is a perspective view of a conference table embodying my invention.

Referring now to the drawings in which like parts are designated by like reference numerals in the various views, there is shown in FIG. 1, a conference table generally designated by the reference numeral 10. The table shown in FIG. 1 has three pedestal supports 11. However, the number of such supports may vary from a single support for a small round, square, or other non-elongated shape, to four, or perhaps even more supports, depending on size and design criteria. Each of the pedestals comprises a base 12 and a hollow vertical column 13. The base and column may be integral or an assembly. The column has an upper free end 14 as shown in FIG. 3.

Figure 2:
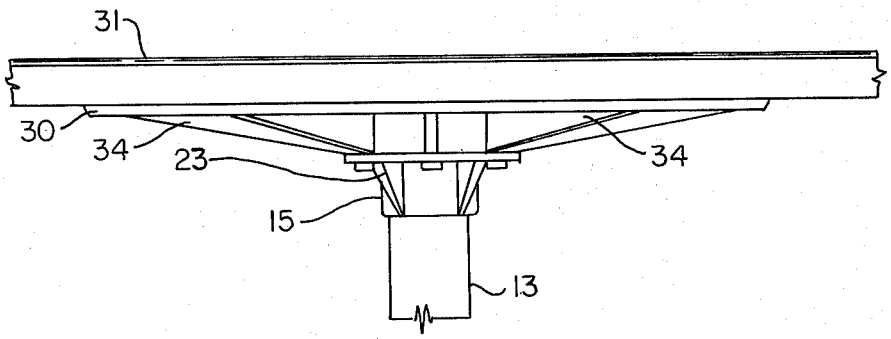
FIG. 2 is a fragmentary elevational view of one of the height adjustable furniture supports of the table shown in FIG. 1 with the reversible collar positioned for the greater height.

The height of the table or other piece of furniture is ultimately determined by the height of the pedestal support and the intermediate members connecting the suppport to the furniture. As is best illustrated in FIGS. 2, 3 and 4, a reversible collar 15 permits a choice of two heights using standard height pedestal members and other standardized components.

The reversible collar 15 has a generally vertical hollow body member 17 which extends between a first end 18 and a second end 19. In between the first and second ends 18 and 19, there is a substantially horizontal load bearing seat 20. In the preferred embodiment, the seat 20 is positioned closer to the first end 18 than it is to the second end 19. The collar 15 is also provided with an external flange 22 which in the preferred embodiment is integral with the vertical hollow body member 17 at the second end 19. For the purpose of supporting and strengthening the flange 22, braces 23 may be provided. In the preferred embodiment, the reversible collar 15 is a cast member with the seat 20, flange 22, and braces 23 all being integral.

Figure 3:
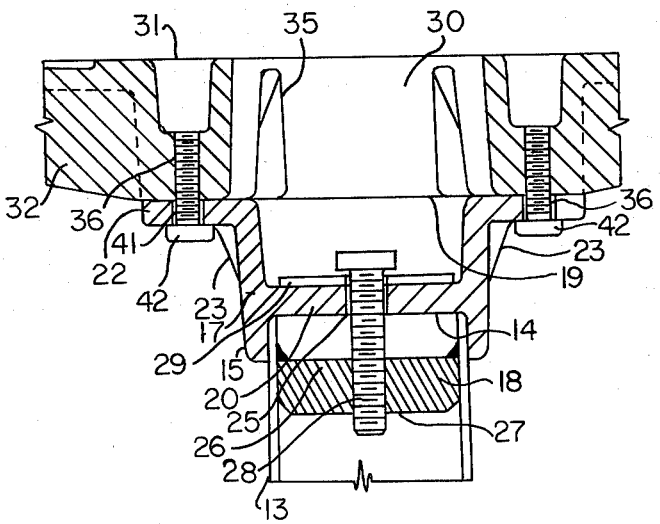
FIG. 3 is an enlarged fragmentary center vertical sectional view of the support shown in FIG. 2.
Figure 4:
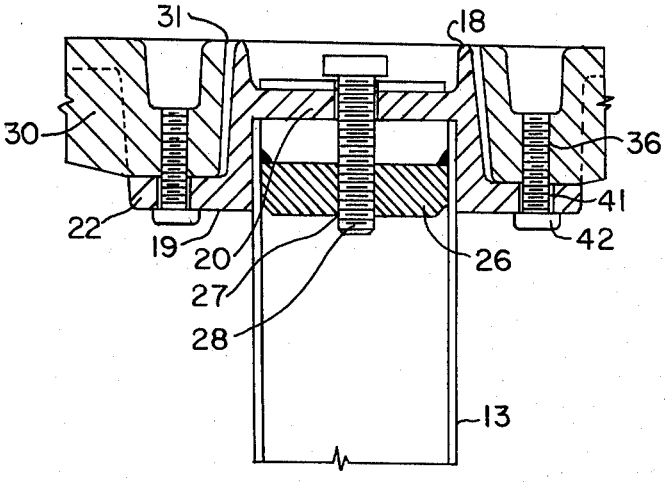
FIG. 4 is an enlarged fragmentary center vertical sectional view of the support with the reversible collar positioned for the lower height.

As shown in FIG. 3, the free end 14 of the column is received within the collar 15 so that the seat 20 rests on top of the free end 14 of the column 13. In order to secure the collar 15 to the column 13, a hole 25 is provided in the seat 20. A nut or other suitable piece 26 having a threaded hole 27 is welded or otherwise secured within the hollow column 13. The threaded hole 27 and the hole 25 are aligned so that a bolt 28 or other suitable fastening device may be inserted through the seat 20 and secured to the nut 26. A washer 29 may also be employed.

Figure 5:
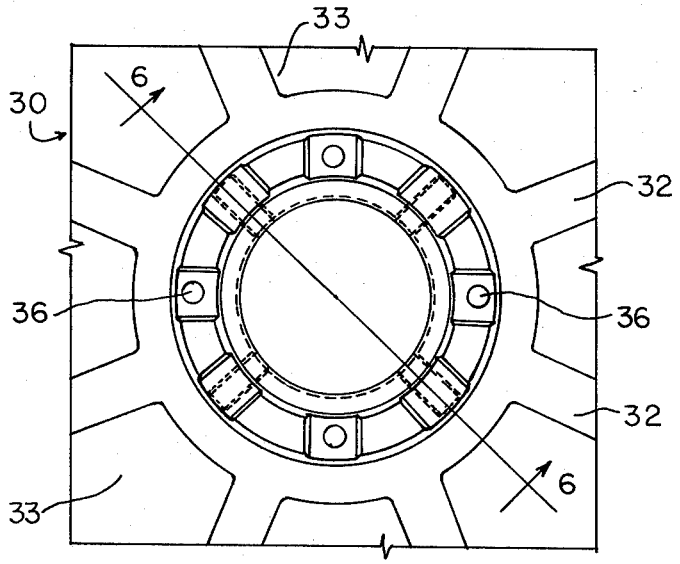
FIG. 5 is a fragmentary top plan view of the furniture support plate.
Figure 6:
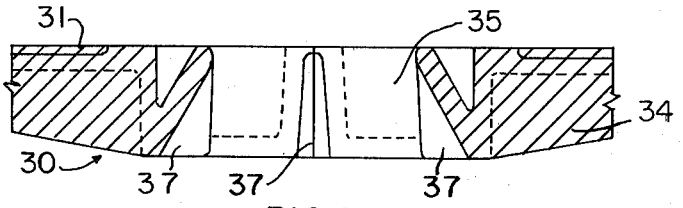
FIG. 6 is a sectional view along the Line 6—6 of FIG. 5.

For the purpose of actually supporting the table top or other piece of furniture, there is a support plate 30 which has a top surface 31. The plate has a series of upper radial ribs 32 and a coplaner border not shown in the drawings that define the top surface 31 with depressed portions 33 as shown in FIG. 5. By means of holes through the rib portions 32, suitable fastening means may be inserted to secure the table top or other piece of furniture to the support plate 30. Lower radial strengthening ribs 34 are also provided on the bottom of the support plate.

The support plate 30 is provided with an opening 35. Around the periphery of the opening 35 there are provided a number of threaded holes 36. Within the opening 35 are a number of internal cavities 37 whose purpose will be later described.

The external flange 22 is of a diameter greater than the opening 35, and thus the flange does not enter into the opening. The flange 22 is provided with a series of holes 41 that align with the threaded holes 36 in the support plate 30 so that bolts such as 42 may be used to secure the support plate 30 to the reversible collar 15.

It will be appreciated that the height of the top surface 31 of the support plate 30 is determined by a combination of the pedestal 11, the reversible collar 15, and the support plate 30. When the reversible collar 15 is in the position shown in FIG. 4, a lower height is obtained than when the collar 15 is positioned as show in FIGS. 3 and 2. To get from the configuration of FIG. 4 to that of FIG. 3, the reversible collar 15 is flipped over—rotated 180°.

The height of the pedestal 11 is the same in both FIGS. 3 and 4 and the height of the support plate 30 is also the same. Therefore, the greater height of the combination shown in FIG. 3 results from the addition of the distance between the side of the seat 20 that fits on top of the column 13 and the flange 22 that abuts the support plate 30. On the other hand, when the reversible collar 15 is positioned as is shown in FIG. 4 the overall height is reduced. When positioned as shown in FIG. 4, the body of the reversible collar 15 is received within the opening 35 until the flange 22 abuts the bottom of the support plate 30. In addition, the portion of the column 13 in the collar 15 between the side of the seat 20 that fits on top of the column and the side of the flange 22 that abuts the support plate is also received in the support plate opening.

When the reversible collar 15 is received within the opening 35 as shown in FIG. 4, the cavities 37 accommodate the braces 23 on the outside of the collar 15.

The collar 15 shown in the drawings may be made with a load bearing seat 20 and flange 22, each having the same thickness of less than 0.35 inches, a thickness which has been found suitable for supporting pieces of furniture such as table tops; the preferred material is aluminum. If one side of the seat 20 is positioned a half inch from the first end 18 of the collar 15 while the other side of the seat 20 is positioned an inch from the second end 19 of the collar, the collar 15 has an overall height of less than 1.85 inches. However, an overall difference of two inches in height results from the use of the combination of the pedestal, reversible collar, and support plate.

While a specific embodiment of the present invention has been shown and described, it will be apparent to those skilled in the art that various changes and modifications may be made without departing from the invention in its broader aspects, and it is, therefore, contemplated in the appended claims to cover all such changes and modifications as fall within the true spirit and scope of the present invention.

I claim:

1. A height adjustable furniture support comprising:
(a) a column having a lower base end and a free upper end;
(b) a reversible collar mounted on the free upper end in either a first or second position; and
(c) a support plate securable to the reversible collar;
(d) the reversible collar further comprising:
(i) first and second ends;
(ii) a substantially horizontal load bearing seat positioned between the first and second ends, either side of the seat being adapted to fit onto the free end of the column; and
(iii) an external flange substantially parallel to the seat;
(e) means for securing the collar to the column in either the first or second position;
(f) the support plate having an opening adapted to receive one end of the collar but not the flange;
(g) means for securing the flange to the support plate with the collar in either the first or second position; and
(h) the seat and the flange cooperating respectively with the column and the support plate to provide, with the reversible collar in the first position, a furniture support of a first pre-selected height and in the second position to provide a furniture support of a second pre-selected height.

2. The height adjustable furniture support of claim 1 wherein:
(a) the means for securing the collar to the column includes means within the column for receiving a threaded fastener and a hole in said seat for insertion of the threaded fastener; and
(b) the opening in the support plate providing access to the fastener for securing the collar to the column.

3. The height adjustable furniture support of claim 1 wherein the load bearing seat is spaced further from the second end of the vertical body of the collar than from the first end of the vertical body of the collar.

4. The height adjustable furniture support of claim 1 wherein the external flange is integral with one end of the collar.

5. The height adjustable furniture support of claim 1 wherein a predetermined part of the collar is received within the support plate opening in the first position and the flange abuts the support plate so that less than the predetermined part is received within the support plate opening in the second position.

6. The height adjustable furniture support of claim 1 wherein the external flange is a greater distance from one end than from the other end of said collar.

7. The height adjustable furniture support of claim 6 wherein the external flange is a greater distance from the first end than from the second end of the collar.

8. The height adjustable furniture support of claim 1 wherein the difference between the first pre-selected height and the second pre-selected height is greater than the height of the reversible collar.

* * * * *